United States Patent [19]

Asai et al.

[11] 4,290,807

[45] Sep. 22, 1981

[54] HARD ALLOY AND A PROCESS FOR THE PRODUCTION OF THE SAME

[75] Inventors: Tsuyoshi Asai; Naoji Fujimori; Takaharu Yamamoto, all of Itami, Japan

[73] Assignee: Sumitomo Electric Industries, Ltd., Osaka, Japan

[21] Appl. No.: 942,499

[22] Filed: Sep. 13, 1978

[30] Foreign Application Priority Data

| | | | |
|---|---|---|---|
| Sep. 20, 1977 | [JP] | Japan | 52/112943 |
| Dec. 23, 1977 | [JP] | Japan | 52/156145 |
| Jan. 24, 1978 | [JP] | Japan | 53/007021 |
| Jan. 24, 1978 | [JP] | Japan | 53/007022 |
| Mar. 15, 1978 | [JP] | Japan | 53/30360 |
| Mar. 16, 1978 | [JP] | Japan | 53/30357 |

[51] Int. Cl.[3] ..... C22C 29/00; B22F 3/00

[52] U.S. Cl. ..... 75/233; 75/237; 75/238; 75/203; 75/204; 75/205; 75/200

[58] Field of Search ..... 75/233, 237, 238, 203, 75/204, 205, 200

[56] References Cited

U.S. PATENT DOCUMENTS

| | | | |
|---|---|---|---|
| 3,690,962 | 9/1972 | Rudy | 148/32 |
| 3,703,368 | 11/1972 | Rudy | 75/175.5 |
| 3,708,355 | 1/1973 | Rudy | 75/175.5 |
| 3,723,104 | 3/1973 | Rudy | 75/134 M |
| 3,779,745 | 12/1973 | Rudy | 75/176 |
| 3,779,746 | 12/1973 | Rudy | 75/176 |
| 3,994,692 | 11/1976 | Rudy | 75/238 |
| 4,049,876 | 9/1977 | Yamamoto et al. | 75/238 |

OTHER PUBLICATIONS

Schwarzkopf et al., *Refractory Hard Metals* (1953), MacMillan Comp., pp. 370–387.

Rudy, Journal of the Less-Common Metals, vol. 33 #1, Oct. 1973, pp. 43–70.

*Primary Examiner*—Brooks H. Hunt

*Attorney, Agent, or Firm*—Wenderoth, Lind & Ponack

[57] ABSTRACT

This invention relates to a hard alloy consisting of a metallic phase and a hard phase having a B1 type crystal structure, and being represented by the following general formula, $$(M_{1a}, M_{2b}, M_{3c})(C_{1-x-y}N_yO_x)_z$$

in which $M_1$ is at least one of Group IVa elements, $M_2$ is at least one of Group VIa elements, $M_3$ is at least one of Group Va elements, C is carbon, N is nitrogen, O is oxygen, a, b, c, x and y are respectively atomic ratios satisfying the relations of $a+b+c=1$, $0.1 \leqq (a+c)/a+b+c) \leqq 0.7$ (c can be zero), $0.05 \leqq x \leqq 0.5$, $0 \leqq y \leqq 0.5$, $0.05 \leqq x+y \leqq 0.6$ and z is an atomic ratio of $(C+N+O)/M_1+M_2+M_3)$ satisfying the relation of $0.1 \leqq z \leqq 0.5$.

13 Claims, 1 Drawing Figure

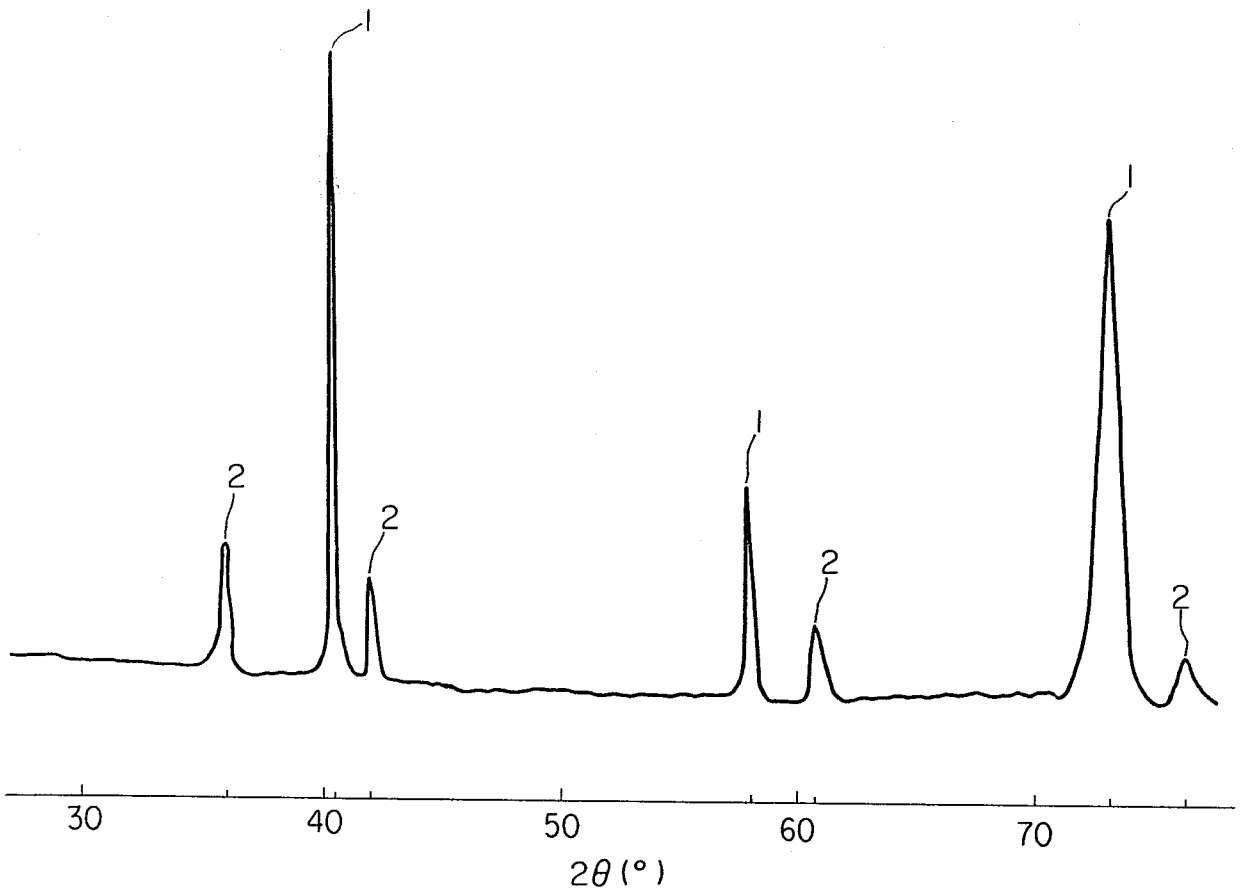
1
2
2
1
2
1
2
30
40
50
60
70
2θ (°)

HARD ALLOY AND A PROCESS FOR THE PRODUCTION OF THE SAME

BACKGROUND OF THE INVENTION

1. Field of the Invention

The present invention relates to a hard alloy and a process for the production thereof and more particularly, it is concerned with a hard alloy with a high melting point metal binder, which is excellent in toughness.

2. Description of the Prior Art

The so-called cemented carbides alloys in which hard carbides of titanium, zirconium, hafnium, vanadium, niobium, tantalum, chromium, molybdenum and tungsten are combined by iron group metals have widely been used as a cutting tool or wear resisting tool. Of late, not only carbides but also carbonitrides have been used to this end. The properties required for cemented carbides as such tools are generally classified into two varieties, that is, toughness and wear resistance. As a result of our studies for a long time, it has been found that toughness is further classified into two varieties, that is, mechanical strength and thermal fatigue. The mechanical strength and wear resistance are in an opposite relation and, when an iron group binder metal, i.e., cobalt in many cases is increased to raise the mechanical strength, for example, the wear resistance is decreased.

On the other hand, change of the thermal fatigue strength is considerably complicated. The thermal fatigue strength is increased with the increase of the quantity of cobalt, but, if the quantity of cobalt is too large, plastic deformation takes place resulting in decrease of the thermal fatigue strength. Accordingly, there is naturally a limitation in the improvement of the thermal fatigue strength by the increase of the quantity of cobalt.

Cutting tools should have a high thermal fatigue resistance strength such as to resist a heavy cutting with a large cutting depth and a large feed in order to raise its efficiency and in the market of wear resistance tools, it has also been required to develop a tool capable of resisting a severe heat cycle for thermal plastic processing, represented typically by hot wire rolling mill. However, the prior art cemented carbide alloys have naturally limits and cannot satisfy these requirements.

In the prior art cemented carbide alloys using cobalt as a binder phase, the plastic deformation resistance at a high temperature is a problem even under practical cutting condition, due to the low melting point of the cobalt phase and the thermal fatigue resistance toughness is also lower than that of materials set forth below. Based on the thought that this problem can be solved by the use of a high melting point metal such as, typically, tungsten instead of cobalt, several alloys have been proposed. For example, U.S. Pat. No. 3,703,368 describes a process for producing a (Ti, W)$C_{1-x}$- W alloy by heating, melting and casting at a temperature of about 2500° C., utilizing the eutectic point of Ti-W-C. This alloy which will hereinafter be referred to as "cast alloy" is markedly superior to the cemented carbide alloys in wear resistance as well as plastic deformation resistance at a high temperature, but has not been put to practical use because of the following problems. The first problem is that the cast alloy has a very low toughness, in particular, mechanical strength. The second problem is that a product of a complicated shape such as of a cemented carbide alloy cannot be prepared cheaply because the product is obtained by casting in spite of its high hardness. The third problem is that alloys limited to near the eutectic point are only obtained through the relationship with the casting temperature. The fourth problem is that the eutectic structure is stabilized by cooling rapidly, but when producing a large size product, the desired structure cannot be given thereby. Furthermore, (Ti,W)(C,N)-W type cast alloys have been proposed, but for the same reasons, these alloys have not been used practically.

It would be obvious to those skilled in the art that if the cast alloy with the above described composition can be prepared by powder metallurgy, the second and third problems described above can be solved and several trials have been made based on this assumption. However, no excellent alloys are given thereby because the composition comprises carbides and high melting point metals such as tungsten and molybdenum which have a very inferior sintering property and, thus, a sufficient strength cannot be obtained.

SUMMARY OF THE INVENTION

It is an object of the present invention to provide a hard alloy with a high melting point metal binder, which is excellent in toughness.

It is another object of the present invention to provide a hard alloy consisting of a metallic phase and a hard phase having a Bl type crystal structure.

It is a further object of the present invention to provide a tool having an excellent plastic deformation resistance at a high temperature and thermal fatigue resistance toughness which are not obtained by WC-Co type alloys.

These objects can be attained by a hard alloy consisting of a metallic phase and a hard phase having a Bl type crystal structure and being represented by the following general formula, $$(M_{1a}, M_{2b})(C_{1-x-y}, N_y, O_x)_z$$

in which $M_1$ is one or more of Group IVa elements, $M_2$ is one or more of Group VIa elements, C is carbon, N is nitrogen, O is oxygen, a, b, x and y are respectively atomic ratios satisfying the relations of $a+b=1$, $0.1 \leqq a/(a+b) \leqq 0.7$, $0.05 < x \leqq 0.5$, $0 \leqq y \leqq 0.5$ and $0.5 < x+y < 0.6$, and z is an atomic ratio of $(C+O+N)/(M_1+M_2)$ satisfying the relation of $0.1 \leqq z \leqq 0.5$.

BRIEF DESCRIPTION OF THE DRAWING

The accompanying drawing is to illustrate the principle and merits of the present invention and shows an X-ray diffraction pattern of an alloy of the present invention having a composition of $(Ti_{0.33}W_{0.67})(C_{0.8}O_{0.2})_{0.33}$, 1 being peaks of W and 2 being peaks of TiC phase.

DETAILED DESCRIPTION OF THE INVENTION

We, the inventors, have made detailed studies on alloys of this type, in particular, elements for forming the hard phase and consequently, have found surprisingly that the sintering property of a hard alloy is markedly improved and, moreover, the toughness thereof is also improved by introducing into the hard phase oxygen which has hitherto been considered to be detrimental to sintering of the hard alloy. Based on this finding, the present invention provides a hard alloy with a high melting point binder, excellent in toughness, as a tool with a high efficiency.

The most important feature of the present invention consists in introducing positively oxygen into the hard phase of a hard alloy. In this alloy, oxygen is hardly introduced into the other part than the hard phase and the hard phase becomes thus one with a composition of $(M_1, M_2)(C, O)_z$ or $(M_1, M_2)(C, O, N)_z$ in which $M_1$ represents one or more metals selected from Group IVa elements of Periodic Table, i.e., Ti, Zr and Hf and $M_2$ represents one or more metal selected from Group VIa elements of Periodic Table, i.e., Cr, Mo and W. This is apparent from the accompanying drawing showing an X-ray diffraction pattern of an alloy of the present invention having a composition of $(Ti_{0.33}W_{0.67})(C_{0.8}O_{0.2})_{0.33}$, in which there are found W and TiC phase only. 1 is peaks of W and 2 is peaks of TiC phase. This is the same in an alloy containing N.

Oxygen is thus present in the hard phase as a solid solution element without forming any oxide. The effects or merits in the case of incorporating oxygen will be apparent from the following Examples and, in general, the alloy strength is increased and the toughness when using as a cutting tool is largely improved.

The specification range of the alloy of the present invention will now be illustrated. The alloy of the present invention is generally represented by the formula (1), $$(M_{1a}, M_{2b}, M_{3c})(C_{1-x-y}N_yO_x)_z \ldots \quad (1)$$

$M_1$: one or more of Group IVa elements
$M_2$: one or more of Groups VIa elements
$M_3$: one or more of Group Va elements
C: carbon
N: nitrogen
O: oxygen In this formula, a, b, c, x and y represent respectively atomic ratios which have the following relations.

Firstly, a, b and c are in the relation of $$a+b+c=1$$

in which c can be zero. Secondly, the oxygen content x satisfies the relation of $$0.05 \leqq x \leqq 0.5$$

since is x is too small, the effect of oxygen is not given while if x is too large, the sintering property is deteriorated. When this relation is satisfied, a high strength alloy can be given without deteriorating the additional effect of oxygen. In a preferred range of $0.08 \leqq x \leqq 0.2$, a strength suitable for a cutting tool can be given. Thirdly, the nitrogen content y satisfies the relation of $$0 \leqq y \leqq 0.5$$

since if y is too large, there is obtained an alloy having an inferior sintering property and low strength. Nitrogen is incorporated depending on the intended use and the incorporation thereof is not always required. At the same time, the sum of oxygen and nitrogen x+y is in the relation of $$0.05 \leqq x+y \leqq 0.6$$

since if the sum is too large, the sintering property is unfavorably affected, and it is necessary to incorporate oxygen in a proportion of 0.05 or more. Carbon, nitrogen and oxygen should be incorporated so as to satisfy the above described range. Addition of B and Si in very small amounts, capable of forming the hard phase of Bl crystal structure in the similar manner to C, N and O, is within the scope of the present invention, but their amounts should be 0.02 or less of C+N+O.

The metallic elements in the alloy of the present invention are a hard material selected from Group IVa elements and a metallic phase selected from Group VIa elements. Group Va elements are effective to raise the strength of the alloy, but are not always necessary.

In the case of containing no Group Va elements, a+b should satisfy the relation of $$0.1 \leqq a/(a+b) \leqq 0.7, \text{ preferably, } 0.15 \leqq a/(a+b) \leqq 0.5$$

since if this is less than 0.1, the proportion of the hard phase is too small to act as a hard alloy while if more than 0.7, the proportion of the metallic phase is too small to give a desired strength.

The ratio of the non-metallic elements to the metallic elements $(z=(C+N+O)/(M_1+M_2+M_3))$ should satisfy the relation of $$0.1 \leqq z \leqq 0.5, \text{ preferably, } 0.15 \leqq z \leqq 0.4$$

since if the ratio is less than 0.1, the proportion of the hard phase is too small, while if more than 0.5, free carbon tends to be precipitated.

As set forth above, addition of Group Va elements is effective to raise the strength of an alloy, but an excessive addition tends to precipitate an $M_2C$ phase and to lower the strength of the alloy as a whole. Therefore, it is desirable to satisfy the relation of $c/(a+b)<0.3$. Of Group IVa elements, Ti is preferable on a commercial scale because it is cheapest and various powdered raw materials are provided. Of Group VIa elements, Mo and W are preferable due to their high melting points and high strengths. Cr, having a melting point of less than 2000° C., is not suitable for the hard phase according to the present invention, but the addition thereof within a limited range serves to improve the corrosion resistance.

In a case where Group VIa element $M_2$ is tungsten, the composition of the hard alloy is represented by the following general formula, $$(M_{1a}, W_b, M_{3c})(C_{1-x-y}N_yO_x)_z$$

$M_1$: one or more of Group IVa elements
W: tungsten
$M_3$: one or more of Group Va elements
C: carbon
N: nitrogen
O: oxygen
a, b, c, x and y: atomic ratios of elements $$a+b+c=1$$

$$0.15 \leqq (a+c)/(a+b+c) \leqq 0.6$$

$$c/(a+c) \leqq 0.3$$

$$0.05 \leqq x \leqq 0.4 \quad 0 \leqq y \leqq 0.5 \quad 0.05 \leqq x+y \leqq 0.5$$

z: $(C+N+O)/(M_1+W+M_3)$ $$0.1 \leqq z \leqq 0.4$$

In this composition, 20 atomic % of the tungsten atom can be replaced by molybdenum.

In a case where Group VIa element $M_2$ is molybdenum, the composition of the hard alloy is represented by the following general formula, $$(M_{1a}, Mo_b, M_{3c})(C_{1-x-y}N_yO_x)_z$$

$M_1$: one or more of Group IVa elements
Mo: molybdenum
$M_3$: one or more of Group Va elements
C: carbon
N: nitrogen
O: oxygen
a, b, c, x and y: atomic ratios of elements $$a+b+c=1$$

$$0.2 \leqq (a+c)/(a+b+c) \leqq 0.7 \quad c/(a+c) \leqq 0.3$$

$$0.05 \leqq x \leqq 0.4 \quad 0 \leqq y \leqq 0.5 \quad 0.05 \leqq x+y \leqq 0.5$$

z: atomic ratio of $(C+N+O)/(M_1+Mo+M_3)$ $$0.1 \leqq z \leqq 0.5$$

In this composition, 25 atomic % or less of the molybdenum atom can be replaced by tungsten.

As is well known, iron group metals, Cu, Ag and Pd are markedly effective as a sintering promoter of high melting point metals and in the present invention, they can also exhibit the similar effect. However, an excessive addition of these elements is detrimental to the heat resistance due to their low melting points. Thus, it is desirable to suppress the sum of these elements to 2% or less of the total number of the atoms.

It is known that in sintering of W, addition of Re, $ThO_2$, Na, K, Ca, Al and Si serves to increase the strength and to control the crystal particles and when the alloy of the present invention contains a large amount of W, this effect is similarly given by the addition thereof. Re is effective to increase the strength of the alloy, but it is not desirable to add a large amount of Re because of being expensive. Addition of Th, Na, K, Ca, Al and Si serves to control the particle size, but an excessive addition thereof rather results in embrittlement. Thus, Re, Th, Na, K, Ca, Si and Al should be added in a proportion of 2% or less of the total number of atoms.

For the production of the alloy of the present invention, it is necessary to control, in particular, the atmosphere during sintering. The inventors have made various studies on a method for dissolving oxygen in TiC and have found that an atmosphere of carbon monoxide is the most suitable. If the pressure of carbon monoxide is less than 0.1 Torr, however, the control cannot positively be carried out. A preferred pressure of carbon monoxide is 0.5 Torr or more. When the pressure of carbon monoxide is high, the following reaction takes place at a low temperature:

$$2CO \rightarrow C + CO_2$$

Further, control of oxygen to be incorporated is effective at a high temperature. Therefore, the temperature of the carbon monoxide atmosphere is preferably 600° C. or higher.

When a product with a small crystal particle size is required, it is desired to use starting materials which are readily pulverizable during mixing and according to the present invention, a desired alloy can be produced by using suitably carbides, oxides, nitride or solid solutions thereof, in combination. Various methods for preparing the hard alloys of the present invention will be illustrated in detail in the following Examples.

The features of the alloy according to the present invention are summarized below:

(i) The toughness is higher than that of cemented carbides having a similar wear resistance.

(ii) The thermal crack resistance is excellent.

(iii) The melt adhesion to steel, copper, etc. at a high temperature is little.

Based on these features, the alloy of the present invention is available for various uses.

When using as a cutting tool, cutting can be carried out with a higher efficiency due to its high toughness than in the case of using cemented carbides. For the wear resisting use, our alloy performs well, in particular, in hot working. That is to say, a hot working can be accomplished at a high temperature with a decreased adhesion to a workpiece and with resisting a severe heat cycle. Since it has lately been required to increase the efficiency, in particular, in hot wire milling, the wire speed is increased and the life of a tool is thus shortened, but our alloy can well be applied to this use without surface roughening of the wire due to the excellent thermal crack resistance.

In the hot working of copper, it is substantially impossible to use cemented carbides as well known, because it is assumed that the binder phase of the cemented carbides diffuses in copper. On the contrary, the alloy of the present invention is free from this disadvantage and has a more excellent wear resistance than tool steels. Therefore, the alloy of the invention is suitable for use in a wire mill and this feature can well be displayed in not only pure copper but also copper alloys such as brass.

Furthermore, cemented carbides can scarcely be used for rotary tools such as drills, reamers, etc., while the alloy of the present invention can favourably be used because of its high toughness.

In addition, the alloy of the present invention is used as a part of a composite or mixed material with marked advantages. Of late, in cutting tools, the so-called surface-coated cemented carbide alloys have become predominant in which the surface of a cemented carbide alloy is coated with a wear resisting material in a thickness of several microns and for the alloy of the present invention, it is also useful to coat the surface thereof with one or more of carbides, nitrides, borides and oxides, and solid solutions thereof in order to raise the wear resistance. These coatings can be provided by the conventional methods such as chemical vapor deposition, sputtering, plasma coating, ionic plating, etc. In this case, the coating effect can well be given without deteriorating the toughness, because there scarcely occurs a brittle $\eta$-phase between the substrate and coating layer, which appears often in the surface-coated cemented carbide alloys.

In large size wear resisting parts, in particular, it is desirable to coat only a part requiring a wear resistance with a material having a high wear resistance, but in the case of using a cemented carbide alloy for a general structural material such as steel or cast iron, a sufficient strength cannot be obtained because of reaction between them. On the other hand, the alloy of the present invention having a high melting point and low reactivity with steel or cast iron can be used in combination therewith and can provide a large wear resisting part with a low cost.

The following examples are given in order to illustrate the present invention in detail without limiting the same.

EXAMPLE 1

86% by weight of tungsten having a mean particle size of 1.5 microns and 14% by weight of titanium carbide having a mean particle size of 1 micron were taken by weighing, mixed by wet process in an attriter for 4 hours and dried to prepare a starting powder with a composition of $(Ti_{0.33}, W_{0.67})C_{0.3}$. The resulting powder was compacted in a cubic of 20×20×10 mm under a pressure of 1.5 tons/cm$^2$ and sintered under the following two conditions:

| | | | |
|---|---|---|---|
| (A) | Present Invention | | |
| | Room Temperature | Vacuum | $10^{-1}$ Torr or less |
| | 1000° C. | | |
| | 1000° C.-1800° C. | CO | 100 Torr |
| | 1800° C. × 1 hour | Vacuum | $5 \times 10^{-2}$ Torr or less |
| (B) | Prior Art | | |
| | 1800° C. × 1 hour | Vacuum | $5 \times 10^{-2}$ Torr |

In each case, the temperature raising speed was 10° C./min and the cooling was carried out in a vacuum of $10^{-2}$ Torr or less. The so obtained samples were subjected to measurement of the contents of carbon and oxygen to thus obtain results shown in Table 1:

TABLE 1

| Sintering Method | Carbon (wt %) | Oxygen (wt %) |
|---|---|---|
| A | 2.65 | 0.42 |
| B | 2.70 | 0.01 |

The compositions of the sintered bodies are as follows:
(A) $(Ti_{0.33}, W_{0.67})(C_{0.89}O_{0.11})_{0.36}$
(B) $(Ti_{0.33}, W_{0.67})(C_{0.997}O_{0.003})_{0.33}$
The transverse rupture strengths of these alloys were measured to obtain results (A) 120 Kg/mm$^2$ and (B) 25 Kg/mm$^2$.

Samples (A) and (B), a commercially sold cemented carbide alloy of ISO P30 and a commercially sold castable carbide $[(Ti_{0.30}Zr_{0.20}W_{0.68})C_{0.35}]$ were subjected to cutting tests under the conditions shown in Table 2:

TABLE 2

| | Test 1 | Test 2 |
|---|---|---|
| Cutting System | Turning | Milling Cutter |
| Workpiece | SCM 3 | SCM 3 |
| Speed (m/min) | 100 | 140 |
| Cutting Depth (mm) | 6 | 4 |
| Feed (mm/rev) | 0.80 | 0.42 |
| Cutting Time (min) | 15 | 20 |

The results of these tests are shown in Table 3:

TABLE 3

| Sample | Test 1 | Test 2 |
|---|---|---|
| (A) | Nose Push 0.01 mm | Good, Depth of Crater 0.005 mm |
| (B) | Nose Push 0.21 mm | Chipping, Life 5 minutes |
| P 30 | Nose Push 0.19 mm* | Good, Depth of Crater 0.06 mm |
| Castable | Nose Push 0.01 mm | Chipping, Life 2 minutes |

TABLE 3-continued

| Sample | Test 1 | Test 2 |
|---|---|---|
| Carbide | | |

Note:
*Cutting Time 7 minutes

As can be seen from these results, the cemented carbide alloy ISO P30 shows a good performance in a cutting test using a milling cutter, but shows a large plastic deformation of edge in a cutting operation with a high efficiency as in Test 1. The castable carbide gives a good result in Test 1, but it meets with chipping when using a milling cutter and cannot be used practically. Sample (B) is hardly resistance to cutting. Sample (A) of the present invention can give good results in both the tests.

EXAMPLE 2

TiO having a mean particle size of 2 microns and TiC having a mean particle size of 2 microns were mixed and heated at 1800° C. to prepare a Bl type solid solution of $Ti(C_{0..6}, O_{0.4})_{0.98}$.

18.1% by weight of the resulting solid solution, 54% by weight of tungsten having a mean particle size of 2 microns and 28.1% by weight of molybdenum having a mean particle size of 2 microns were mixed in an analogous manner to Example 1 to prepare a starting powder with a composition of 25 atom % Mo—25 atom % W—25 atom % Ti—15 atoms % C—10 atom % O, compacted and sintered in vacuum at 1800° C., but there was obtained only an alloy having pores remained and a transverse rupture strength of about 20 Kg/mm$^2$.

On the other hand, in the case of sintering according to the present invention as described below, there was obtained a pore-free and good alloy having a transverse rupture strength of 105 Kg/mm$^2$ and a composition of $(Ti_{0.33}Mo_{0.33}W_{0.33})(C_{0.63}O_{0.37})_{0.34}$.

| | |
|---|---|
| Room Temperature - 1000° C. | Vacuum ($1 \times 10^{-1}$ Torr or less) |
| 1000-1700° C. | CO (300 Torr) |
| 1700° C. × 1 hour | Vacuum ($5 \times 10^{-2}$ Torr or less) |

EXAMPLE 3

Alloys having the compositions shown in Table 4 were prepared in an analogous manner to Example 1, finished in a shape of SPU 854 and then subjected to cutting tests with a front top rake of 0° and a side rake of 6° under the following conditions to compare their properties:

| | |
|---|---|
| Workpiece | S45C ($H_B$ 240) |
| Speed | 80 m/min |
| Feed | 1.2 mm/rev |
| Cutting Depth | 5-13 mm |

This workpiece was a forged article surface-roughened and thus the cutting depth varied within a range of 5 to 13 mm. Considering the dispersion of the workpiece, the test was repeated two to four times to obtain average lives shown in Table 4.

As evident from these results, the alloys of the present invention have excellent properties of 3 to 5 times as much as the prior art cemented carbides. Furthermore, many of these alloys are more excellent than commercially sold cast alloy and the best alloy shows a 60% improved property.

TABLE 4

| Composition | Average Life | Number of Repetition | Life Exhaustion |
|---|---|---|---|
| Our Invention | | | |
| $(Ti_{0.33},W_{0.67})(C_{0.8}O_{0.2})_{0.33}$ | 130 | 4 | Chipping |
| $(Ti_{0.33}W_{0.67})(C_{0.6}N_{0.2}O_{0.2})_{0.33}$ | 150 | 2 | Chipping |
| $(Ti_{0.33}Mo_{0.67})(C_{0.8}O_{0.2})_{0.33}$ | 108 | 2 | Breakage |
| $(Ti_{0.33}Mo_{0.67})(C_{0.6}N_{0.2}O_{0.2})_{0.33}$ | 121 | 3 | Chipping |
| $(Ti_{0.18}W_{0.82})(C_{0.8}O_{0.2})_{0.18}$ | 113 | 2 | Worn |
| $(Ti_{0.33}Mo_{0.33}W_{0.33})(C_{0.6}N_{0.2}O_{0.2})_{0.33}$ | 163 | 4 | Chipping |
| $(Ti_{0.27}Zr_{0.07}W_{0.66})(C_{0.8}O_{0.2})_{0.33}$ | 143 | 3 | Chipping |
| $(Ti_{0.27}Hf_{0.07}W_{0.66})(C_{0.6}N_{0.2}O_{0.2})_{0.33}$ | 110 | 4 | Chipping |
| $(Ti_{0.24}V_{0.09}Mo_{0.33}W_{0.33})(C_{0.8}O_{0.2})_{0.33}$ | 109 | 4 | Breakage |
| $(Ti_{0.27}Nb_{0.07}Mo_{0.33}W_{0.33})(C_{0.8}O_{0.2})_{0.33}$ | 127 | 4 | Chipping |
| $(Ti_{0.27}Ta_{0.07}Mo_{0.33}W_{0.33})(C_{0.6}N_{0.2}O_{0.2})_{0.33}$ | 175 | 4 | Chipping |
| $(Ti_{0.33}W_{0.67})(C_{0.8}O_{0.2})_{0.33}$ - 1 at % Ni | 128 | 2 | Chipping |
| $(Ti_{0.33}Mo_{0.67})(C_{0.68}N_{0.12}O_{0.2})_{0.34}$ - 1 at % Ni | 118 | 2 | Chipping |
| $(Ti_{0.33}Mo_{0.33}W_{0.34})(C_{0.68}N_{0.12}O_{0.2})_{0.33}$ - 0.5 at % Pd | 150 | 2 | Chipping |
| $(Ti_{0.10}Zr_{0.25}W_{0.65})(C_{0.6}N_{0.2}O_{0.2})_{0.32}$ | 125 | 4 | Chipping |
| $(Ti_{0.33}W_{0.67})(C_{0.8}O_{0.2})_{0.33}$ - 1 at % Co | 121 | 2 | Chipping |
| $(Ti_{0.33}W_{0.67})(C_{0.8}O_{0.2})_{0.33}$ - 0.5 at % Fe | 117 | 2 | Chipping |
| $(Ti_{0.33}W_{0.67})(C_{0.8}O_{0.2})_{0.33}$ - 0.5 at % Cu | 105 | 2 | Plastic Deformation of Edge |
| $(Ti_{0.33}W_{0.67})(C_{0.8}O_{0.2})_{0.3}$ - 0.5 at % Ag | 115 | 2 | Plastic Deformation of Edge |
| Comparison | | | |
| $(Ti_{0.33}W_{0.67})C_{0.33}$ | 42 | 4 | Breakage |
| $(Ti_{0.33}Mo_{0.33}W_{0.33})C_{0.33}$ | 34 | 2 | Breakage |
| $(Ti_{0.37}W_{0.63})(C_{0.75}O_{0.25})_{0.097}$ | 5.5 | 2 | Plastic Deformation of Edge |
| $(Ti_{0.6}W_{0.4})(C_{0.8}O_{0.2})_{1.0}$ | 2 | 2 | Chipping |
| $(Ti_{0.33}W_{0.67})(C_{0.2}N_{0.4}O_{0.4})_{0.33}$ | 2 | 2 | Breakage |
| $(Ti_{0.32}W_{0.68})(C_{0.79}O_{0.21})_{0.34}$ - 5 at % Ni | 30 | 2 | Plastic Deformation of Edge |
| Prior Art | | | |
| ISO P20 | 15 | 2 | Breakage due to Thermal Crack |
| ISO P30 | 32 | 3 | Breakage due to Thermal Crack |
| Castable Carbide | 114 | 2 | Chipping |

EXAMPLE 4

The alloys prepared in an analogous manner to Example 3 were subjected to cutting using a milling cutter for comparison. In this case, wet process milling was carried out by fitting the insert with a chamfer horning 0.4 mm × −15° to a 10 inch cutter with an axial rake of +8° and radial rake of 0°:

| | |
|---|---|
| Workpiece | S55C ($H_B$270) |
| Speed | 120 m/min |
| Feed | 0.5 mm/rev |
| Cutting Depth | 10 mm |

The test results are shown in Table 5.

TABLE 5

| Composition | Life (min) | Life Exhaustion |
|---|---|---|
| Our Invention | | |
| $(Ti_{0.33}W_{0.67})(C_{0.8}O_{0.2})_{0.33}$ | 46 | Chipping |
| $(Ti_{0.33}W_{0.67})(C_{0.6}N_{0.2}O_{0.2})_{0.33}$ | 58 | Crater Wear |

TABLE 5-continued

| Composition | Life (min) | Life Exhaustion |
|---|---|---|
| $(Ti_{0.33}Mo_{0.67})(C_{0.8}O_{0.2})_{0.33}$ | 48 | Chipping |
| $(Ti_{0.33}Mo_{0.67})(C_{0.6}N_{0.2}O_{0.2})_{0.33}$ | 56 | Crater Wear |
| $(Ti_{0.18}W_{0.82})(C_{0.8}O_{0.2})_{0.18}$ | 45 | Crater Wear |
| $(Ti_{0.33}Mo_{0.33}W_{0.33})(C_{0.6}N_{0.2}O_{0.2})_{0.33}$ | 70 | Crater Wear |
| $(Ti_{0.27}Zr_{0.07}W_{0.66})(C_{0.8}O_{0.2})_{0.33}$ | 48 | Chipping |
| $(Ti_{0.27}Hf_{0.07}W_{0.66})(C_{0.6}N_{0.2}O_{0.2})_{0.33}$ | 43 | Chipping |
| $(Ti_{0.24}V_{0.09}Mo_{0.33}W_{0.33})(C_{0.8}O_{0.2})_{0.33}$ | 51 | Chipping |
| $(Ti_{0.27}Nb_{0.07}Mo_{0.33}W_{0.33})(C_{0.8}O_{0.2})_{0.33}$ | 64 | Crater Wear |
| $(Ti_{0.27}Ta_{0.07}Mo_{0.33}W_{0.33})(C_{0.6}N_{0.2}O_{0.2})_{0.33}$ | 74 | Crater Wear |
| $(Ti_{0.33}W_{0.67})(C_{0.8}O_{0.2})_{0.33}$ - 1 at % Ni | 43 | Crater Wear |
| $(Ti_{0.33}Mo_{0.67})(C_{0.68}N_{0.12}O_{0.2})_{0.34}$ - 1 at % Ni | 50 | Crater Wear |
| $(Ti_{0.33}Mo_{0.33}W_{0.34})(C_{0.68}N_{0.12}O_{0.2})_{0.33}$ - 0.5 at % Pd | 62 | Crater Wear |
| $(Ti_{0.33}W_{0.67})(C_{0.8}O_{0.2})_{0.33}$ - 1 at % Co | 42 | Crater Wear |
| $(Ti_{0.33}W_{0.67})(C_{0.8}O_{0.2})_{0.33}$ - 0.5 at % Fe | 40 | Crater Wear |
| $(Ti_{0.33}W_{0.67})(C_{0.8}O_{0.2})_{0.33}$ - 0.5 at % Cu | 40 | Crater Wear |
| $(Ti_{0.33}W_{0.67})(C_{0.8}O_{0.2})_{0.3}$ - 0.5 at % Ag | 41 | Crater Wear |
| $(Ti_{0.10}Zr_{0.25}W_{0.65})(C_{0.6}N_{0.2}O_{0.2})_{0.32}$ | 48 | Crater Wear |
| Comparison | | |
| $(Ti_{0.33}W_{0.67})C_{0.33}$ | 5 | Breakage |
| $(Ti_{0.33}Mo_{0.33}W_{0.33})C_{0.33}$ | 4 | Breakage |
| $(Ti_{0.37}W_{0.67})(C_{0.75}O_{0.25})_{0.097}$ | 12 | Plastic Deformation |

TABLE 5-continued

| Composition | Life (min) | Life Exhaustion |
|---|---|---|
| | | of Edge |
| $(Ti_{0.6}W_{0.4})(C_{0.8}O_{0.2})_{1.0}$ | 3 | Chipping |
| $(Ti_{0.33}W_{0.67})(C_{0.2}N_{0.4}O_{0.4})_{0.33}$ | 21 | Breakage |
| $(Ti_{0.32}W_{0.68})(C_{0.79}O_{0.21})_{0.34}$ - 5 at % Ni | 30 | Plastic Deformation of Edge |
| Prior Art | | |
| ISO P20 | 20 | Breakage due to Thermal Crack |
| ISO P30 | 33 | Breakage due to Thermal Crack |
| Castable Carbide | 5 | Chipping |

EXAMPLE 5

85% by weight of tungsten having a mean particle diameter of 1 micron and 15% by weight of TiC having a mean particle diameter of 1 micron were mixed by wet process, dried, compacted and then sintered under the following conditions to produce a hot wire rolling mill which outer diameter was 6 inches:

| | |
|---|---|
| Room Temperature - 1000° C. | Vacuum $5 \times 10^{-1}$ Torr or less |
| 1000–1600° C. | CO Atmosphere Pco = 100 Torr |
| 1600–1700° C. | Vacuum $1 \times 10^{-1}$ Torr or less |
| 1700° C. | For 1 hour |
| Temperature Raising Speed 5° C./min | |

Analysis of the resulting alloy showed a composition of $(Ti_{0.34}W_{0.66})(C_{0.78}O_{0.22})_{0.37}$. The roll was arranged at the final stage of a rolling process for comparison with the prior art WC-20% Co alloy. The rolled weight until the life was exhausted was as follows:

Our Invention: Life was not exhausted even at a rolled weight of 1200 tons

Cemented Carbide Alloy: Life was exhausted at a rolled weight of 500 tons

In the cemented carbide alloy, a number of thermal cracks were produced and the roughened surface affected unfavourably a wire as a product, which was regarded as "life", while in the present invention, no thermal cracks were produced and the rolling was carried out until 1200 tons.

EXAMPLE 6

A hot wire rolling mill was made of each of alloys with the compositions shown in Table 6 and subjected to rolling of a workpiece of SUS 304 for comparison of their lives. In this case, the rolling was carried out from a wire rod diameter of 8 mmϕ to that of 6 mmϕ.

The additional elements were added in the forms of:

Re: Added as a W powder containing 5 at % of Re

K: Added as $K_2O$

Ca: Added as CaO

Si: Added as $SiO_2$

Al: Added as a W or Mo powder containing 5 at % of Al

The sintering was carried out in a similar manner to Example 5.

TABLE 6

| Composition | Life |
|---|---|
| $(Ti_{0.34}W_{0.66})(C_{0.86}O_{0.14})_{0.35}$ - 1.0 at % K | 840 |
| $(Ti_{0.34}W_{0.66})(C_{0.86}O_{0.14})_{0.34}$ - 0.8 at % Ca | 780 |
| $(Ti_{0.33}W_{0.67})(C_{0.82}O_{0.18})_{0.36}$ - 1.2 at % Al | 700 |
| $(Ti_{0.33}W_{0.67})(C_{0.86}O_{0.14})_{0.35}$ - 1.3 at % Si | 700 |
| $(Ti_{0.35}W_{0.33}Mo_{0.32})(C_{0.48}N_{0.39}O_{0.13})_{0.36}$ - 1.0 at % K | 850 |
| $(Ti_{0.27}W_{0.68}Ta_{0.05})(C_{0.45}N_{0.35}O_{0.2})_{0.42}$ - 1.2 at % K | 870 |
| $(Ti_{0.27}Zr_{0.07}W_{0.66})(C_{0.76}O_{0.24})_{0.35}$ - 1.1 at % Re | 800 |
| $(Ti_{0.34}W_{0.61}Ta_{0.05})(C_{0.86}O_{0.14})_{0.35}$ - 0.7 at % Ca-0.4 at % Ni-0.7 at % Ca | 760 |
| $(Ti_{0.31}Mo_{0.64}V_{0.05})(C_{0.85}N_{0.04}O_{0.11})_{0.30}$ - 0.6 at % Pd-1.3 at % Al | 960 |
| $(Ti_{0.33}W_{0.67})(C_{0.997}O_{0.003})_{0.33}$ | 200 |
| $(Ti_{0.34}W_{0.67})(C_{0.86}O_{0.14})_{0.35}$ | 480 |
| $(Ti_{0.33}W_{0.67})(C_{0.996}O_{0.004})_{0.33}$ - 1.0 at % Re | 280 |
| Cemented Carbides (WC-20% Co) | 250 |

EXAMPLE 7

In a wire rolling process of an ordinary steel (carbon content: 0.3% or less), the so-called guide roll for guiding a wire rod to a predetermined working tool met with thermal cracks and breakages, because the wire rod was at a high temperature such as about 1000° C. and the heat cycle was severe.

This guide roll was made of each of materials as shown in Table 6 and compared with comparative articles as to their lives:

TABLE 7

| Composition | Rolled Weight (ton) | Life Exhaustion |
|---|---|---|
| Our Invention | | |
| $(Ti_{0.33}W_{0.67})(C_{0.8}O_{0.2})_{0.33}$ | 13500 | Worn |
| $(Ti_{0.33}W_{0.67})(C_{0.6}N_{0.2}O_{0.2})_{0.33}$ | 14000 or more | Worn |
| $(Ti_{0.33}Mo_{0.67})(C_{0.8}O_{0.2})_{0.33}$ | 7800 | Surface-roughened Wire Rod |
| $(Ti_{0.25}Mo_{0.75})(C_{0.5}N_{0.25}O_{0.25})_{0.20}$ | 10600 | Worn |
| $(Ti_{0.33}Mo_{0.26}W_{0.41})(C_{0.6}N_{0.2}O_{0.2})_{0.33}$ | 14500 or more | Worn |
| $(Ti_{0.27}Zr_{0.07}W_{0.66})(C_{0.6}O_{0.4})_{0.33}$ | 13000 or more | Worn |
| $(Ti_{0.27}Hf_{0.07}W_{0.66})(C_{0.6}N_{0.2}O_{0.2})_{0.33}$ | 13000 or more | Worn |
| $(Ti_{0.24}V_{0.10}Mo_{0.33}W_{0.33})(C_{0.8}O_{0.2})_{0.33}$ | 13000 or more | Worn |
| $(Ti_{0.27}Ta_{0.07}Mo_{0.33}W_{0.33})(C_{0.6}N_{0.2}O_{0.2})_{0.33}$ | 15000 or more | Worn |
| $(Ti_{0.27}Nb_{0.07}Mo_{0.33}W_{0.33})(C_{0.72}O_{0.28})_{0.33}$ | 14000 or more | Worn |
| $(Ti_{0.33}W_{0.67})(C_{0.8}O_{0.2})$ - 1 at % Ni | 12900 | Breakage |
| $(Ti_{0.33}Mo_{0.33}W_{0.33})(C_{0.6}N_{0.2}O_{0.2})_{0.33}$ - 0.5 at % Pd | 14000 | Worn |
| Comparison | | |
| Cemented Carbide Alloy (WC-17% Co) | 2000 | Surface-roughened |
| $(Ti_{0.33}W_{0.67})C_{0.33}$ | 6000 | Breakage |

EXAMPLE 8

88.2% by weight of tungsten powder having a mean particle size of 2 microns and 11.8% by weight of TiC powder having a mean particle size of 1 micron were taken by weighing, ball milled by wet process, dried, mixed with a binder, formed into a drill of 10 mm in diameter and sintered in an analogous manner to Example 1. The composition of the resulting alloy was $(Ti_{0.28}W_{0.72})(C_{0.78}O_{0.22})_{0.29}$.

Using a workpiece to be cut of steel S 45 C with a thickness of 40 mm, the drill obtained in this way, a commercially sold high speed steel SKH 9 and a commercially sold super-fine cemented carbide alloy were subjected to a life test under a dry process cutting condition of a drill circumferential cutting speed of 12 m/min and a feed of 0.125 mm/rev. The drill of the present invention made 180 holes and was capable of further cutting, while the high speed steel drill made only 28 holes and the super-fine cemented carbide alloy made 76 holes.

EXAMPLE 9

A roll for hot rolling a copper wire rod was made in an analogous manner to Example 8 and fitted to the final stage of a finishing stand for working in a diameter of 8 mmϕ. In the prior art tool steel and cemented carbide alloy, their lives were exhausted at 300 to 500 tons due to adhesion to the roll surface in the former case and to surface-roughening of the roll surface in the latter case. On the other hand, the roll of the present invention was resistant to use of 1500 tons or more with holding the surface state markedly good.

EXAMPLE 10

A mold for gear blank was made of the alloy of the present invention described in Example 1 by diamond grinding and then used for hot forging of a ferruginous sintered body with a porosity of 29%. The temperature in this case was 900° C. In the case of the die steel mold of the prior art, the life was exhausted when 150000 workpieces were worked, while the article of the present invention was capable of working 80000 workpieces.

EXAMPLE 11

An alloy with a composition of $(Ti_{0.38}W_{0.62})(C_{0.81}O_{0.19})_{0.37}$ was prepared in an analogous manner to Example 1 and subjected to various coating treatments and then to the following cutting test.

| | |
|---|---|
| Workpiece | SCM 4 ($H_B$ 280) 80 ϕ × 400 |
| Speed | 140 m/min |
| Cutting Depth | 2 mm |
| Feed | 0.36 mm/rev |
| Shape of Insert | SNG 432 |
| Tool Holder | N 11R - 44 |

The results are shown in Table 8.

TABLE 8

| | Coating | Life (min) | |
|---|---|---|---|
| Our Invention | TiC 6μ | 50 | Flank Wear Life |
| " | TiC 5μ/$Al_2O_3$ 1μ | 80 | " |
| " | TiC 2μ/Ti(CN) 2 μ/ TiN 2μ | 70 | " |
| " | TiN 6μ | 50 | |
| " | $Al_2O_3$ 4μ | 60 | Chipping Life |
| " | TiN 8μ* | 85 | Flank Wear Life |
| " | Ti(CN) 7μ** | 70 | Chipping Life |
| Cemented Carbides | ISO P 10 | 18 | Crater Wear Life |
| Cemented Carbides | P 20 | 7 | " |
| Marketed Coated Insert | TiC 6μ | 25 | Crater Wear Life |
| Marketed Coated Insert | TiC 5μ/$Al_2O_3$ 1μ | 40 | " |
| Marketed coated Insert | TiN 6μ | 35 | " |

Note:
*Physical Vapor Deposition
**Plasma Chemical Vapor Deposition (Other coatings were carried out by conventional chemical vapor deposition method.)

In the case of the prior art cemented carbides and commercially sold coated inserts, the lives were exhausted by the crater wear, while in the product of the present invention, the crater wear was very little and cutting was possible until the life was exhausted by flank wear. Under this condition, cemented carbides showed a remarkable crater wear and in the commercially sold coated inserts, the crater wear proceeded markedly after the coating was worn. In the present invention, the life was not exhausted by the crater wear since the substrate of the present invention was very excellent in wear resistance.

EXAMPLE 12

A cylinder with an outer diameter of 15 mm, inner diameter of 10 mm and height of 40 mm was made of an alloy having a composition of $(Ti_{0.33}W_{0.67})(C_{0.8}O_{0.2})_{0.33}$ in analogous manner to Example 1 and arranged in the center of a cylindrical sand mold with an inner diameter of 50 mmϕ and a height of 40 mm, in which a cast steel (C 0.45%, Mn 0.6%) was then poured. After cooling, the cast product was released from the mold and then subjected to a machining treatment to give a die. In the die obtained in this way, it was found that there hardly occurred a reaction between the hard alloy and cast steel and the properties of the hard alloy itself were hardly changed throughout the processing.

In the case of using a cemented carbide alloy of the prior art, on the other hand, the temperature of the molten steel was so high that the shape of the die was not kept and a marked reaction took place.

We claim:

1. A sintered hard alloy consisting of a metallic phase and a hard phase having a B1 type crystal structure and being represented by the following general formula:

$$(M_{1a}, M_{2b})(C_{1-x-y}, N_y, O_x)_z$$

in which $M_1$ is at least one of the Group IVa elements, $M_2$ is at least one of the Group VIa elements, C is carbon, N is nitrogen, O is oxygen, a, b, x and y are respectively atomic ratios satisfying the relations of $a+b=1$, $0.1 \leqq a/(a+b) \leqq 0.7$, $0.08 < x \leqq 0.5$, $0 \leqq y \leqq 0.5$ and $0.05 \leqq x+y \leqq 0.6$ and z is an atomic ratio of $(C+O+N)/(M_1+M_2)$ satisfying the relation of $0.1 \leqq z \leqq 0.5$.

2. The sintered hard alloy as claimed in claim 1, wherein $M_2$ is at least one of tungsten and molybdenum.

3. A sintered hard alloy consisting of a metallic phase and a hard phase having a B1 type crystal structure and being represented by the following general formula:

$$(M_{1a}, M_{2b}, M_{3c})(C_{1-x-y}N_yO_x)_z$$

in which $M_1$ is at least one of the Group IVa elements, $M_2$ is at least one of the Group VIa elements, $M_3$ is at least one of the Group Va elements, C is carbon, N is nitrogen, O is oxygen, a, b, c, x and y are respectively atomic ratios satisfying the relations of $a+b+c=1$, $0.1 \leqq (a+c)/(a+b+c) \leqq 0.7$, $c/(a+c) \leqq 0.3$, $0.08 \leqq x \leqq 0.5$, $0 \leqq y \leqq 0.5$, and $0.05 \leqq x+y \leqq 0.6$, and z is an atomic ratio of $(C+N=O)/(M_1+M_2+M_3)$ satisfying the relation of $0.1 \leqq z \leqq 0.5$.

4. The sintered hard alloy as claimed in claim 3, wherein $M_2$ is at least one of tungsten and molybdenum.

5. The sintered hard alloy as claimed in Claim 1, wherein rhenium is further added in a proportion of at most 2% based on all the number of atoms.

6. The sintered hard alloy as claimed in claim 3, wherein rhenium is further added in a proportion of at most 2% based on all the number of atoms.

7. The sintered hard alloy as claimed in claim 1, wherein at least one of potassium, calcium, sodium, silicon and aluminum is further added in a proportion of at most 2% based on all the number of atoms.

8. The sintered hard alloy as claimed in claim 3, wherein at least one of potassium, calcium, sodium, silicon and aluminum is further added in a proportion of at most 2% based on all the number of atoms.

9. The sintered hard alloy as claimed in claim 1, wherein at least one of the iron group metals, copper, silver and palladium is used as a sintering promoter.

10. The sintered hard alloy as claimed in claim 3, wherein at least one of the iron group metals, copper, silver and palladium is used as a sintering promoter.

11. A process for producing a sintered hard alloy represented by the following general formula:

$$(M_{1a}, M_{2b}, M_{3c})(C_{1-x-y}N_yO_x)_z$$

in which $M_1$ is at least one of the Group IVa elements, $M_2$ is at least one of the Group VIa elements, $M_3$ is at least one of the Group Va elements, C is carbon, N is nitrogen, O is oxygen, a, b, c, x, y and z are respectively atomic ratios satisfying the relations of $a+b+c=1$ in which c can be zero, $0.05 \leqq x \leqq 0.5$, $0 \leqq y \leqq 0.5$, $0.05 \leqq x+y \leqq 0.6$ and z is an atomic ratio of $(C+N+O)/(M_1+M_2+M_3)$ satisfying the relation of $0.1 \leqq z \leqq 0.5$, which comprises pressing and sintering the powdered starting materials necessary to produce the sintered alloy of the above formula, at least a part of the sintering step being carried out in an atmosphere of carbon monoxide of at least $10^{-1}$ Torr.

12. The process as claimed in claim 11, wherein the atmosphere of carbon monoxide is kept during at least a part of the heating of at least 600° C.

13. The process as claimed in claim 11, wherein at least two of carbides, nitrides, oxides and solid solutions thereof are used as starting powders.

* * * * *